US005238019A

United States Patent [19]

Beyer et al.

[11] Patent Number: 5,238,019

[45] Date of Patent: Aug. 24, 1993

[54] HOLD-DOWN ASSEMBLAGE FOR A GAS COMPRESSOR VALVE ASSEMBLY

[75] Inventors: Ronald W. Beyer, Painted Post; Gary A. Templar, Beaver Dams, both of N.Y.

[73] Assignee: Dresser-Rand Company, Corning, N.Y.

[21] Appl. No.: 942,002

[22] Filed: Sep. 8, 1992

[51] Int. Cl.[5] ..... F16K 27/12

[52] U.S. Cl. ..... 137/454.4

[58] Field of Search ..... 137/454.2, 454.4, 454.6

[56] References Cited

U.S. PATENT DOCUMENTS 1,073,338 9/1913 Fairhurst ..... 137/454.2 X
1,259,639 3/1918 Laing ..... 137/454.6
2,304,991 12/1942 Foster ..... 137/454.4
3,369,741 2/1968 Weggeman ..... 137/454.4

*Primary Examiner*—Stephen M. Hepperle
*Attorney, Agent, or Firm*—Bernard J. Murphy

[57] ABSTRACT

In lieu of the customary valve assembly-holding set-screw, a ram, slidably engaged with the central bore of a valve housing cover, is adjustably held against the valve assembly by a plate-type ram cover. The latter cover is bolted to the valve housing cover. To insure that product gas can not escape from the valve housing, the ram has an annular shoulder thereon which prevents its removal outwardly from the housing cover; the ram can only be removed via the inner surface of the housing cover. Too, the ram has an O-ring seal thereon which is confined between the ram and the housing cover.

7 Claims, 1 Drawing Sheet

HOLD-DOWN ASSEMBLAGE FOR A GAS COMPRESSOR VALVE ASSEMBLY

This invention pertains to retainers for gas compressor valve assemblies, or devices or assemblages, which serve to engage and hold compressor valve assemblies in place in a valve housing, and in particular to a novel hold-down assemblage, for a gas compressor valve assembly, which (a) requires less holding torque per fastener, (b) provides better fluid sealing, and (c) more surely secures the valve assembly in place.

Prior art valve hold-down devices employ a specially configured valve housing cover, which is centrally bored and tapped, a setscrew in penetration thereof for engaging and holding the valve in place, a setscrew-girdling gasket and a seal nut, threadably engaged with the setscrew for restraining the gasket and securing the setscrew in adjusted disposition.

Such prior art hold-down devices, for having only the one fastener for the valve, i.e., the setscrew, require the imposition of a great torque thereof—typically, in the order of six hundred and twenty lb/ft, approximately. Too, the valve housing cover has to be bored and tapped, of course, to accommodate the setscrew. The setscrew is entered into, and removed from the housing cover via the outer surface of the cover. If the setscrew, inadvertently, removes from the valve housing cover, clearly the process gas exits into the atmosphere.

What has been needed is a hold-down assemblage for a gas compressor valve assembly which obviates the need to torque fasteners therefor to such a high value, which requires a simple valve housing cover which requires no centrally tapped bore, and which supplants the setscrew with means for preventing release of the product gas to the atmosphere.

It is an object of this invention to set forth a hold-down assemblage for a gas compressor valve assembly which meets the aforesaid need.

Particularly, it is an object of this invention to set forth a hold-down assemblage for a gas compressor valve assembly, comprising a valve housing cover; first means, in slidable penetration of said cover, for (a) engagement with, and (b) holding, a gas compressor valve assembly in place in a valve housing; and second means, for (a) abuttingly engaging said first means, and (b) restraining said first means in holding engagement with such compressor valve assembly.

Figure 1:
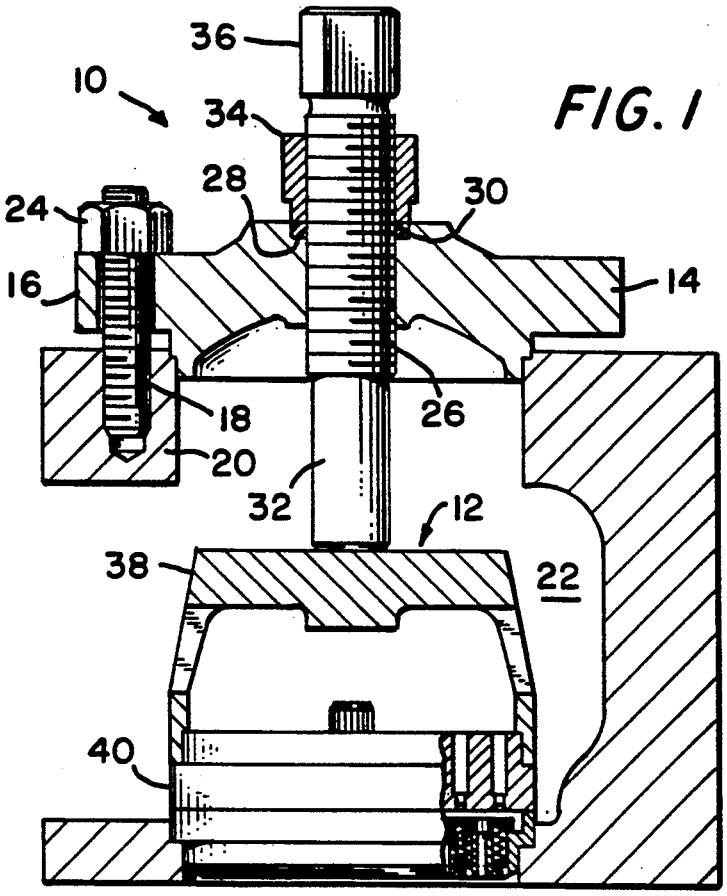
FIG. 1 PRIOR ART
Figure 2:
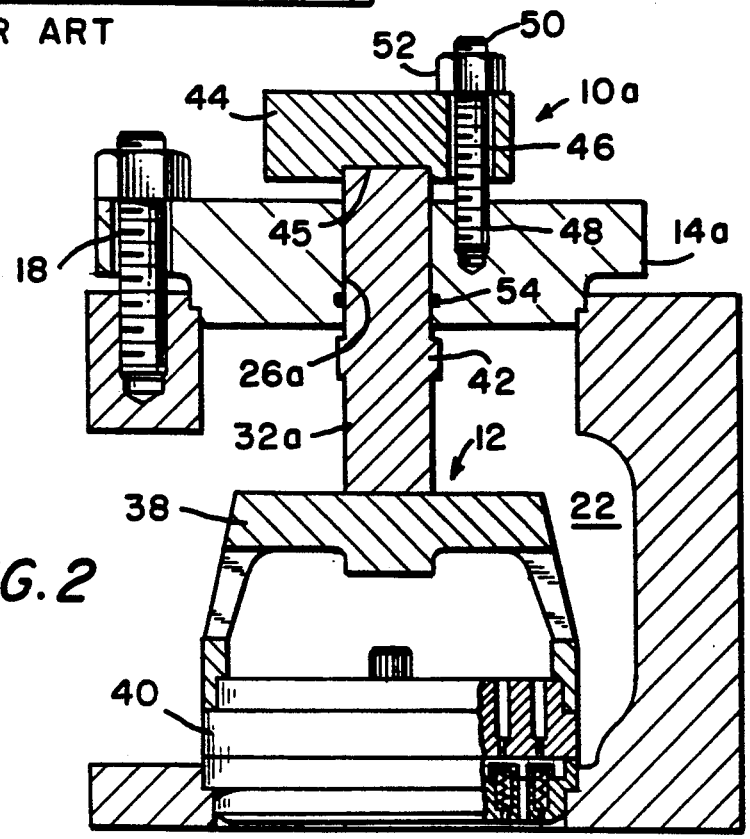

Further objects of this invention, as well as the novel features thereof, will become apparent by reference to the following description, taken in conjunction with the accompanying figures, in which:

FIG. 1 is an elevation view, mostly in cross-section, of a prior art, hold-down assemblage for a gas compressor valve assembly; and FIG. 2 is an elevation view, also mostly in cross-section, of an embodiment of the invention.

As shown in FIG. 1, a typical, prior art hold-down assemblage 10 for a gas compressor valve assembly 12, comprises a specially configured, domed, valve housing cover 14. The latter has a radially extending flange 16 which is bore-holed to receive studs 18 (only one of which is shown) extending from a wall 20 of a valve housing 22. The outermost ends of the studs 18 receive nuts 24 for securing the cover 14 to the housing 22.

The cover 14 is centrally bored and tapped at 26, and has a countersunk relief 28, circumscribing the central bore 26, in which to receive a gasket 30. A set-screw 32, which threadedly carries a seal nut 34 thereupon, is threadedly received in the bore 26. The outermost end of the setscrew has a hexagonal head 36; the latter is employed to torque the innermost end of setscrew 32 into secure, holding engagement thereof with the cage 38 of the gas compressor valve 40. The cage 38 and valve 40 comprise a valve assembly, and as is well understood by those skilled in this technology, the setscrew 32 forces the valve assembly 12 into fast engagement with an underlying seal (not shown), and fixes the valve assembly 12 in position in the housing 22. When the setscrew has been duly torqued against the cage 38, to the aforesaid approximately six hundred and twenty lb-ft, the seal nut 34 is turned down into fast engagement with the gasket 30.

As can be appreciated, the cover 14 has to be bored and tapped, and requires the relief for the gasket 30. The setscrew 32 enters the cover 14 via the outermost surface of the latter and, accordingly, can remove from the cover 14, inadvertently, with the consequence that the process gas can be released to the atmosphere. The setscrew 32 has to be torqued heavily, as noted, as it is the sole, valve assembly-retaining fastener.

The improved hold-down assemblage 10*a* for a gas compressor valve assembly 12 is shown in FIG. 2, where same or similar index numbers thereon signify same or similar parts and or components as so-indexed in FIG. 1.

The valve housing cover 14*a* is a simple, plate-type component which is bore-holed about its periphery to receive the studs 18. The cover 14*a* is centrally bored at 26*a*, but is not threaded as such is not necessary. The bore 26*a* slidably receives an elongate ram 32*a*, the latter having an annular shoulder 42 formed thereon intermediate the length thereof. One end of the ram 32*a* abuttingly engages the cage 38 and the opposite end protrudes through the cover 14*a*. Another plate-type, ram cover 44 has a centrally formed recess 45 formed therein, and receives in the recess, in only abutting engagement, the opposite end of the ram 32*a*. Ram cover 44 has a plurality of bolt-receiving bore-holes 46 (only one thereof being shown), and cover 14*a* has a corresponding tapped holes 48 (again, only one being shown) formed therein. Studs 50, fixed in holes 48 are received through holes 46 and receive nuts 52 (only one being shown) on the outermost ends thereof. By torquing each of the nuts 52, on the studs 50, to a significantly lower lb-ft value on each (than required for the sole setscrew 32 of FIG. 1), the clamping of the valve assembly 12 in place is adjustably effected. Ram 32*a* has an annular recess formed therein, intermediate the shoulder 42 and the outermost end thereof, in which is seated an O-ring seal 54, for fluid-sealing between the ram 32*a* and the cover 14*a*.

Because of the shoulder 42, the ram 32*a* has to be set into the cover 14*a* via the innermost surface of the cover 14*a*. Clearly, then, there is no possibility of product gas escaping from the valve housing 22, even with the ram cover 44 displaced from the cover 14*a*. In a worst case scenario, the ram 32*a* would rise through the cover 14*a* until the shoulder 42 engages the innermost surface of the cover 14*a*, and thereat it would stop. The seal 54 would travel therewith, of course, and maintain the fluid seal.

While we have described our invention in connection with a specific embodiment thereof, it is to be clearly understood that this is done only by way of example, and not as a limitation to the scope of the invention as set forth in the objects thereof and in the appended claims. For instance, the O-ring seal 54 could be set into a recess formed therefor within the central bore in the cover 14*a*. Too, the shoulder 42, albeit shown as integral with the ram 32*a*, could be a separate annulus fastened to an otherwise unshouldered ram. These, and all other similar modifications and/or alternative embodiments, which will occur to others from an understanding of our invention, are deemed to be within the ambit of our disclosure, and embraced by the following claims.

We claim:

1. A hold-down assemblage for a gas compressor valve assembly, comprising:

a valve housing cover;

first means, in slidable penetration of said cover, for (a) engagement with, and (b) holding, a gas compressor valve assembly in place in a valve housing; and second means, for (a) abuttingly engaging said first means, and (b) restraining said first means in holding engagement with such compressor valve assembly; wherein said cover has a first, outer surface, and a second, opposite, inner surface; and said first means has means formed thereon for preventing withdrawal thereof, from said cover, through said outer surface thereof.

2. A hold-down assemblage, according to claim 1, further including:

means interposed between said cover and said first means for fluid-sealing therebetween.

3. A hold-down assemblage for a gas compressor valve assembly, comprising:

a valve housing cover;

first means, in slidable penetration of said cover, for (a) engagement with, and (b) holding, a gas compressor valve assembly in place in a valve housing; and second means, for (a) abuttingly engaging said first means, and (b) restraining said first means in holding engagement with such compressor valve assembly; wherein said first means comprises an elongate ram; and said ram has an annular shoulder formed thereon intermediate the length thereof.

4. A hold-down assemblage, according to claim 1, wherein:

said second means comprises a plate-type cover, and means for adjustably fastening the latter to said housing cover.

5. A hold-down assemblage, according to claim 4, wherein:

said first means comprises an elongate ram; and said plate-type cover has a recess formed therein in which, abuttingly, to receive an end of said ram.

6. A hold-down assemblage, according to claim 1, wherein:

said first means comprises an elongate ram; and said ram has a first end for extension thereof outwardly from said first, outer surface of said cover, and a second end for projection thereof inwardly from said second, opposite, inner surface of said cover.

7. A hold-down assemblage, according to claim 4, wherein:

said valve housing cover has bore holes formed therethrough;

said plate-type cover has tapped holes formed therein; and said adjustably fastening means comprises (a) threaded studs threadedly engaged with said tapped holes and in penetration of said bore holes, and (b) nuts fastened to said studs.

* * * * *